US007382995B2

(12) United States Patent
Itoh et al.

(10) Patent No.: US 7,382,995 B2
(45) Date of Patent: Jun. 3, 2008

(54) FIXING APPARATUS, IMAGE FORMING APPARATUS AND FIXING APPARATUS HEATING METHOD

(75) Inventors: Kazuyoshi Itoh, Nakai-machi (JP); Yasutaka Naito, Nakai-machi (JP); Motofumi Baba, Nakai-machi (JP); Hideaki Ohhara, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 117 days.

(21) Appl. No.: 11/391,337

(22) Filed: Mar. 29, 2006

(65) Prior Publication Data

US 2007/0047991 A1 Mar. 1, 2007

(30) Foreign Application Priority Data

Aug. 24, 2005 (JP) ..... 2005-243187

(51) Int. Cl.
*G03G 15/20* (2006.01)

(52) U.S. Cl. ..... 399/67; 219/216; 399/69; 399/328; 430/124.1

(58) Field of Classification Search ..... 399/329, 399/328, 69, 67; 219/216; 347/156; 430/124.1, 430/124.3

See application file for complete search history.

(56) References Cited

U.S. PATENT DOCUMENTS 6,725,009 B1 * 4/2004 Tatematsu et al. ..... 399/329
6,782,231 B2 * 8/2004 Fuma et al. ..... 399/328
6,904,259 B2 * 6/2005 Tsueda et al. ..... 399/67 X
7,212,775 B2 * 5/2007 Kachi ..... 399/329
2006/0083528 A1 * 4/2006 Mori et al. ..... 399/67
2006/0099015 A1 * 5/2006 Miyazaki ..... 399/328

FOREIGN PATENT DOCUMENTS

JP A-10-254263 9/1998
JP A-11-352804 12/1999
JP A-2002-148983 5/2002
JP 2002-311745 A * 10/2002

* cited by examiner

*Primary Examiner*—Sophia S Chen
(74) *Attorney, Agent, or Firm*—Morgan, Lewis & Bockius LLP

(57) ABSTRACT

A fixing apparatus for fixing an unfixed image on a recording material includes: a heating member having a conductive layer, that is rotatably provided; a pressure member that is rotatably provided and that is brought into press-contact with the heating member, thereby forms a fixing nip part to pass the recording material between the pressure member and the heating member; a heating unit that performs induction heating on the heating member via the conductive layer; a driving unit that rotates the heating member; and an attachment/separation unit that attaches or separates the heating member to/from the pressure member.

6 Claims, 9 Drawing Sheets

FIXING APPARATUS, IMAGE FORMING APPARATUS AND FIXING APPARATUS HEATING METHOD

This application claims the benefit of Japanese Patent Application No. 2005-243187 filed in Japan on Aug. 24, 2005, which is hereby incorporated by reference.

BACKGROUND

1. Technical Field

The present invention relates to a fixing apparatus or the like to fix a toner image onto a recording material in an image forming apparatus utilizing e.g. an electrophotographic method.

2. Related Art

Generally, in an image forming apparatus using powder toner, at a process to fix a toner image, a method of electrostatically transferring a toner image onto a recording medium, then placing the recording medium between a heating member and a pressure member, and heat-melting the toner image thereby press-fixing the toner image to the recording medium, is widely employed. For the heating of the heating member, an arrangement where the heating member has a conductive layer such that the conductive layer generates heat by electromagnetic induction heating has been proposed. The electromagnetic induction heating is providing an exciting coil to generate a varying magnetic field near the conductive layer (heating member) and causing the conductive layer to generate heat by an eddy current generated in the conductive layer. According to the electromagnetic induction heating, as the heating member is directly heated and the range of high temperature by heating is extremely limited, the heating member can be heated to a predetermined temperature in a short time. Accordingly, in comparison with heating using a halogen lamp or the like as a heating source, warm-up time of the fixing apparatus can be reduced, and electric consumption can be reduced. Further, as it is not necessary to previously heat the heating member when the apparatus is not used, the electric consumption can be further reduced.

On the other hand, as the heating member (fixing member), as well as a heating roller, an endless fixing belt is generally used. The endless fixing belt is a belt put around plural support rollers, or is a belt with an inside pressure member and is circulate-driven without a roller. The fixing belt has a thin heat-resisting resin layer or the like as a base layer. As the thermal capacity of the fixing belt is smaller than that of the heating roller, the warm-up time is shorter in comparison with that of the apparatus using the heating roller. Further, in the non-expanded type fixing belt, the area to be contact with another member can be reduced, thereby heat transfer to the other member can be reduced. Accordingly, further efficient warming up can be performed.

In a fixing apparatus where an endless belt as a heating member is heated by electromagnetic induction, when the endless belt is put around plural rollers, the exciting coil is provided to face the inner surface or outer surface of the belt. On the other hand, when the endless belt is circulate-driven without a roller, the exciting coil is provided in a position close and facing the outer peripheral surface of the endless belt. Then, a varying magnetic field is generated in a direction through the endless belt, and an eddy current is induced around the magnetic field.

Generally, a high frequency current supplied to the exciting coil is generated by switching a direct current at a high frequency, and constant current control or constant energy control is performed. Further, upon electric power supply to the exciting coil, the temperature of the fixing member as a heated body is detected with a temperature sensor and the amount of supplied power is controlled and/or power supply ON/OFF control is performed so as to maintain a predetermined temperature.

In recent image forming apparatuses, further reduction of warm-up time is needed. Accordingly, when a printout request has been inputted from a user, it is necessary to immediately heat the fixing apparatus (heating member) to a fixing temperature.

On the other hand, in a fixing apparatus employing e.g. the electromagnetic induction heating, the warm-up time can be reduced as described above, however, as the temperature of the heating member rises in a short time, it frequently overshoots, i.e., it exceeds the upper limit of a desired temperature range. When the overshoot occurs, the heating member or the like is damaged by the overheating, and the life of the heating member may be reduced or the member may be broken.

To address the above problems, it may be arranged such that the level of electric power supplied to the exciting coil during the warm-up is gradually lowered and the inclination of a heat-up curve of the heating member is gradually reduced, thereby the occurrence of overshoot is suppressed.

However, in this method, the warm-up time of the heating member becomes long, and the advantage of the electromagnetic induction heating cannot be utilized. Further, since the power supplied to the exciting coil is set at multiple levels, the power supply ON/OFF control is frequently performed. In this case, a secondary fault such as flicker easily occurs.

Note that these problems are not limited to the fixing apparatus employing the above-described electromagnetic induction heating but similarly occur in a fixing apparatus having a mechanism to quickly heat the heating member.

SUMMARY

According to an aspect of the present invention, a fixing apparatus for fixing an unfixed image on a recording material includes: a heating member, having a conductive layer, that is rotatably provided; a pressure member that is rotatably provided and that is brought into press-contact with the heating member, thereby forms a fixing nip part to pass the recording material between the pressure member and the heating member; a heating unit that performs induction heating on the heating member via the conductive layer; a driving unit that rotates the heating member; and an attachment/separation unit that attaches or separates the heating member to/from the pressure member.

BRIEF DESCRIPTION OF THE DRAWINGS

The above and other object, features and advantages of the present invention will become more apparent from the following detailed description when taken in conjunction with the accompanying drawings, wherein.

DETAILED DESCRIPTION

Hereinbelow, an exemplary embodiment of the present invention will now be described in detail in accordance with the accompanying drawings.

Figure 1:
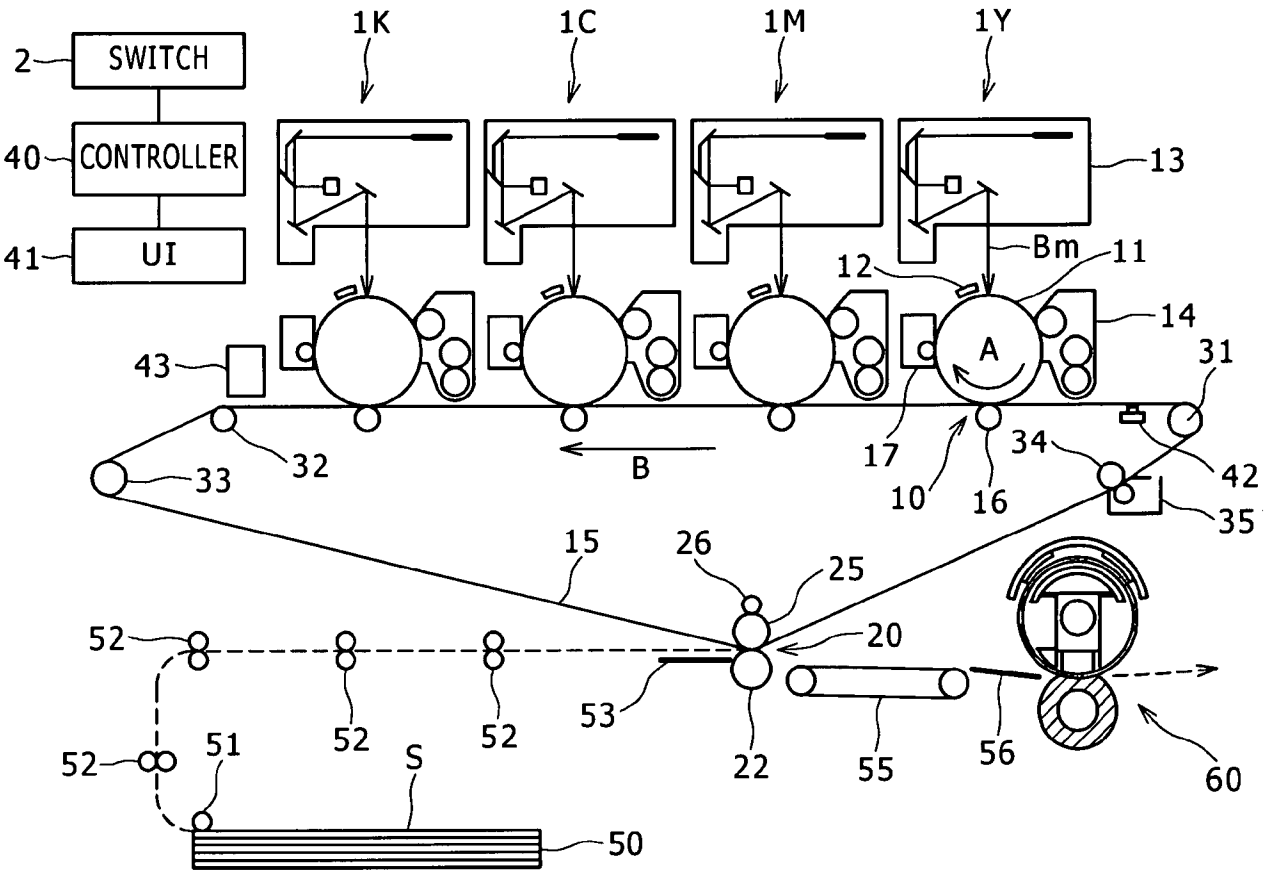
FIG. 1 is a schematic cross-sectional view showing the entire configuration of an image forming apparatus according to an exemplary embodiment of the present invention.

FIG. 1 is a schematic cross-sectional view showing the entire configuration of an image forming apparatus according to the exemplary embodiment. The image forming apparatus in FIG. 1 is a tandem-type and intermediate-transfer type image forming apparatus. The image forming apparatus has plural image forming units 1Y, 1M, 1C and 1K, in which toner images of respective color components are formed by an electrophotographic method, and a first transfer unit 10 to sequentially transfer (first-transfer) the respective color component toner images formed with the respective image forming units 1Y, 1M, 1C and 1K onto an intermediate transfer belt 15. Further, the image forming apparatus has a second transfer unit 20 to transfer (second-transfer) the overlaid toner images (unfixed toner image) on the intermediate transfer belt 15 onto a sheet S as a recording material, and a fixing apparatus 60 to fix the second-transferred image onto the sheet S. Further, the image forming apparatus has a controller 40 as an example of a controller to control the operations of the respective devices (units), a user interface (UI) 41 to receive a user's instruction, and a switch 2 to turn ON/OFF the power of the image forming apparatus.

In this exemplary embodiment, each of the image forming units 1Y, 1M, 1C and 1K has a photoreceptor drum 11 to rotate in an arrow A direction, a charger 12 to charge the photoreceptor drum 11 and a laser exposure unit 13 to write an electrostatic latent image on the photoreceptor drum 11 (in the figure, an exposure beam is denoted by "Bm"). Further, each of the image forming units 1Y, 1M, 1C and 1K has a developer 14, containing color component toner, to visualize the electrostatic latent image on the photoreceptor drum 11, a first transfer roller 16 to transfer the color component toner image formed on the photoreceptor drum 11 onto the intermediate transfer belt 15 in the first transfer unit 10, and a drum cleaner 17 to remove residual toner on the photoreceptor drum 11. The image forming units 1Y, 1M, 1C and 1K are arranged in approximately straight line in the order of yellow (Y), magenta (M), cyan (C) and black (K) from the upstream side of the intermediate transfer belt 15.

The intermediate transfer belt 15 is a film type endless belt of resin such as polyimide or polyamide containing an appropriate amount of anti-static agent such as carbon black. The belt has a specific volume resistance of $10^6$ to $10^{14}$ Ωcm, and its thickness is e.g. about 0.1 mm. The intermediate transfer belt 15 is circulate-driven with various rollers at a predetermined speed in a direction B in FIG. 1. The various rollers include a drive roller 31, driven with a motor (not shown) to attain an excellent constant speed, to rotate the intermediate transfer belt 15, a support roller 32 to support the intermediate transfer belt 15 extended along the direction of the array of the photoreceptor drums 11 in approximately straight line, a tension roller 33 to apply a constant tensile force to the intermediate transfer belt 15 and to function as a correction roller to prevent walk of the intermediate transfer belt 15, a backup roller 25 provided in a second transfer unit 20, and a cleaning backup roller 34 provided in a cleaning unit to sweep residual toner on the intermediate transfer belt 15.

The first transfer unit 10 has a first transfer roller 16 provided to face the photoreceptor drum 11 with the intermediate transfer belt 15 therebetween. The first transfer roller 16 has a shaft and a sponge layer as an elastic layer fixed around the shaft. The shaft is a columnar bar of metal such as iron or SUS. The sponge layer is a sponge cylindrical roller formed with blend rubber containing NBR, SBR and EPDM with conductive agent such as carbon black, and its specific volume resistance is $10^{7.5}$ to $10^{8.5}$ Ωcm. The first transfer roller 16 is provided in press-contact with the photoreceptor drum 11 with the intermediate transfer belt 15 therebetween. Further, a voltage having an opposite polarity (first transfer bias) to toner charging polarity (hereinafter, minus polarity) is applied to the first transfer roller 16. In this arrangement, the toner images on the respective photoreceptor drums 11 are sequentially electrostatically drawn onto the intermediate transfer belt 15, and a toner image is formed with the overlaid toner images on the intermediate transfer belt 15. Note that in this exemplary embodiment, the image forming units 1Y, 1M, 1C and 1K, the intermediate transfer belt 15, the first transfer roller 16 and the like constitute a toner image forming unit.

The second transfer unit 20 as an example of a transfer unit has a second transfer roller 22 provided on the toner image holding side of the intermediate transfer belt 15 and a backup roller 25. The backup roller 25 has a tube of carbon-diffused blend rubber containing EPDM and NBR as its surface and EPDM rubber inside. The backup roller 25 has a surface resistance of $10^7$ to $10^{10}$ Ω/□, and its hardness is set to e.g. 70° (ASKER C). The backup roller 25 is provided on the rear surface side of the intermediate transfer belt 15 as an electrode facing the second transfer roller 22. A metal feeding roller 26, to which a second transfer bias is stably applied, is provided in contact with the backup roller 25.

On the other hand, the second transfer roller 22 has a shaft and a sponge layer as an elastic layer fixed around the shaft. The shaft is a columnar bar of metal such as iron or SUS. The sponge layer is a sponge cylindrical roller formed with blend rubber containing NBR, SBR and EPDM with conductive agent such as carbon black, and its specific volume resistance is $10^{7.5}$ to $10^{8.5}$ Ωcm. The second transfer roller 22 is provided in press-contact with the backup roller 25 with the intermediate transfer belt 15 therebetween. Further, the second transfer roller 22 is grounded. The second transfer bias is generated between the second transfer roller 22 and the backup roller 25, and the toner image is second-transferred onto the sheet S conveyed to the second transfer unit 20.

Further, on the downstream side of the intermediate transfer belt 15 in the second transfer unit 20, an intermediate transfer belt cleaner 35 to remove residual toner and paper powder on the intermediate transfer belt 15 after second transfer thereby cleans the surface of the intermediate transfer belt 15 is attachably/separably provided with respect to the intermediate transfer belt 15. On the other hand, on the upstream side of the yellow image forming unit 1Y, a reference sensor (home position sensor) 42 to generate a reference signal for matching of image forming timing in each of the image forming units 1Y, 1M, 1C and 1K is provided. Further, on the downstream side of the black image forming unit 1K, an image density sensor 43 for image quality control is provided. The reference sensor 42 recognizes a predetermined mark on the rear side of the intermediate transfer belt 15 and generates a reference signal. The image forming units 1Y, 1M, 1C and 1K start image formation in accordance with an instruction from the controller 40 based on the recognition of the reference signal.

Further, in the image forming apparatus according to this exemplary embodiment, as a paper conveyance system, a paper tray 50 to hold the sheet S, a pickup roller 51 to pick up the sheet S accumulated in the paper tray 50 at predetermined timing and convey the sheet, a conveyance roller 52 to convey the sheet S fed with the pickup roller 51, a conveyance chute 53 to send the sheet S conveyed with the conveyance roller 52 to the second transfer unit 20, a conveyance belt 55 to convey the sheet S, after second transfer by the second transfer roller 22, to the fixing apparatus 60, and a fixing entrance guide 56 to guide the sheet S into the fixing apparatus 60.

Next, the basic image forming process in the image forming apparatus according to this exemplary embodiment will be described. In the image forming apparatus in FIG. 1, image data outputted from an image input terminal (IIT) (not shown), a personal computer (PC) (not shown) or the like is subjected to predetermined image processing by an image processing device (IPS) (not shown) then to image forming operation by the image forming units 1Y, 1M, 1C and 1K. In the IPS, shading correction, positional shift correction, brightness/color space conversion, gamma correction, various image editing such as frame deletion, color editing and moving editing are performed on the input reflectance data. The image data subjected to the image processing is converted to Y, M, C and K color material gray level data and outputted to the laser exposure unit 13.

In the laser exposure unit 13, the exposure beam Bm outputted from e.g. a semiconductor laser is emitted on the photoreceptor drums 11 of the respective image forming units 1Y, 1M, 1C and 1K in correspondence with the input color material gray level data. In the photoreceptor drums 11 of the respective image forming units 1Y, 1M, 1C and 1K, the surface is charged with the charger 12, then the surface is exposed with the laser exposure unit 13, and an electrostatic latent image is formed. The formed electrostatic latent images are developed as Y, M, C and K color toner images with the respective image forming units 1Y, 1M, 1C and 1K.

The toner images formed on the photoreceptor drums 11 of the image forming units 1Y, 1M, 1C and 1K are transferred onto the intermediate transfer belt 15 in the first transfer unit 10 where the photoreceptor drums 11 are in contact with the intermediate transfer belt 15. More particularly, in the first transfer unit 10, a voltage (first transfer bias) having an opposite polarity to toner charging polarity (minus polarity) is applied to the base material of the intermediate transfer belt 15 from the first transfer roller 16, and the toner images are sequentially overlaid on the surface of the intermediate transfer belt 15 thereby the first transfer is performed.

When the toner images have been sequentially transferred onto the surface of the intermediate transfer belt 15, the intermediate transfer belt 15 is moved, then the toner image is conveyed to the second transfer unit 20. When the toner image has been conveyed to the second transfer unit 20, in the paper conveyance system, the pickup roller 51 rotates at the timing of conveyance of the toner image to the second transfer unit 20, and the sheet S in a predetermined size is supplied from the paper tray 50. The sheet S supplied by the pickup roller 51 is conveyed with the conveyance roller 52, then sent to the second transfer unit 20 via the conveyance chute 53. Before the sheet S arrives at the second transfer unit 20, the sheet S is temporarily stopped, then as a registration roller (not shown) rotates at the timing of movement of the intermediate transfer belt 15 holding the toner image, positioning is performed between the position of the sheet S and the position of the toner image.

In the second transfer unit 20, the second transfer roller 22 is pressed into contact with the backup roller 25 via the intermediate transfer belt 15. At this time, the sheet S conveyed at synchronized timing is held between the intermediate transfer belt 15 and the second transfer roller 22. Then, a voltage (second transfer bias) having the same polarity as that of the toner charging polarity (minus polarity) is applied from the feeding roller 26, and a transfer electric field is formed between the second transfer roller 22 and the backup roller 25. Then, the unfixed toner image held on the intermediate transfer belt 15 is electrostatically transferred at once onto the sheet S in the second transfer unit 20 where the sheet is pressed between the second transfer roller 22 and the backup roller 25.

Thereafter, the sheet S where the toner image has been electrostatically transferred is conveyed with the second transfer roller 22 in a state where it is separated from the intermediate transfer belt 15, to the conveyance belt 55 on the downstream side of the second transfer roller 22 in the paper conveyance direction. The conveyance belt 55 conveys the sheet S to the fixing apparatus 60 at an optimum conveyance speed for the fixing apparatus 60. The unfixed toner image on the sheet S conveyed to the fixing apparatus 60 is subjected to fixing processing using heat and pressure by the fixing apparatus 60, thereby fixed onto the sheet S. Then the sheet S where a fixed image has been formed is conveyed to a discharge paper tray provided at a discharge port of the image forming apparatus.

On the other hand, when the transfer to the sheet S has been completed, residual toner on the intermediate transfer belt 15 is conveyed to the cleaning unit by the rotation of the intermediate transfer belt 15, and removed from the intermediate transfer belt 15 with the cleaning backup roller 34 and the intermediate transfer belt cleaner 35.

Next, the fixing apparatus 60 as an example of a fixing unit used in the image forming apparatus according to this exemplary embodiment will be described.

Figure 2:
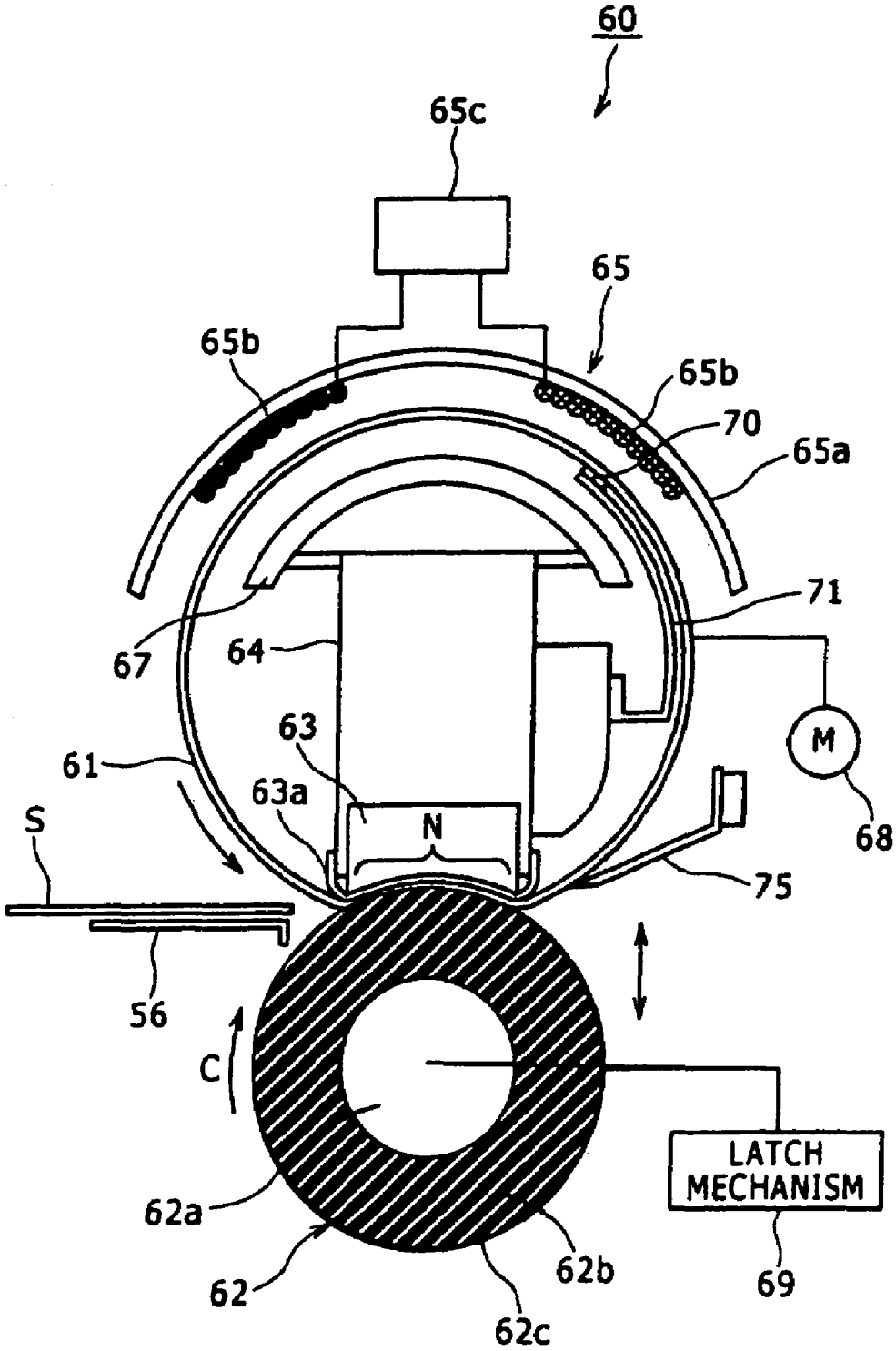
FIG. 2 is a cross-sectional view showing the configuration of a fixing apparatus provided in the image forming apparatus.

FIG. 2 is a cross-sectional view showing the configuration of the fixing apparatus 60 according to this exemplary embodiment. As shown in FIG. 2, the fixing apparatus 60 includes a fixing belt 61 as an example of a heating member (endless belt member) having an endless peripheral surface, a pressure roller 62 provided in press-contact with the outer peripheral surface of the fixing belt 61, as an example of a pressure member or a press-contact member to rotate the fixing belt 61, a pressing pad 63 provided in press-contact with the pressure roller 62 via the fixing belt 61 inside the fixing belt 61, a pad support member 64 to support the pressing pad 63 or the like, an electromagnetic induction heating member 65, formed along the outer peripheral shape of the fixing belt 61 and provided away from the fixing belt 61 with a predetermined gap, as a heating unit or a supply unit to perform electromagnetic induction heating on the fixing belt 61 in its lengthwise direction, and a ferrite member 67 provided along the inner peripheral surface of the fixing belt 61 inside the fixing belt 61, to enhance the heating efficiency of heating of the fixing belt 61 by the electromagnetic induction heating unit 65.

Further, in the fixing apparatus 60 according to this exemplary embodiment, as described later, the fixing belt 61 is driven and the pressure roller 62 is driven-rotated in accordance with the rotation of the fixing belt 61. The fixing apparatus 60 has a drive motor 68 as a drive unit to drive the fixing belt 61.

Further, in the fixing apparatus 60 according to this exemplary embodiment, the fixing belt 61 and the pressure roller 62 can be brought into contact or separated as necessary. Accordingly, the fixing apparatus 60 has a latch mechanism 69 as an attachment/separation unit to fix an attachment position on the fixing belt 61 side and to separate the pressure roller 62 from the fixing belt 61. The latch mechanism 69 may be a combination of a motor and an eccentric cam or the like.

Figure 3A:
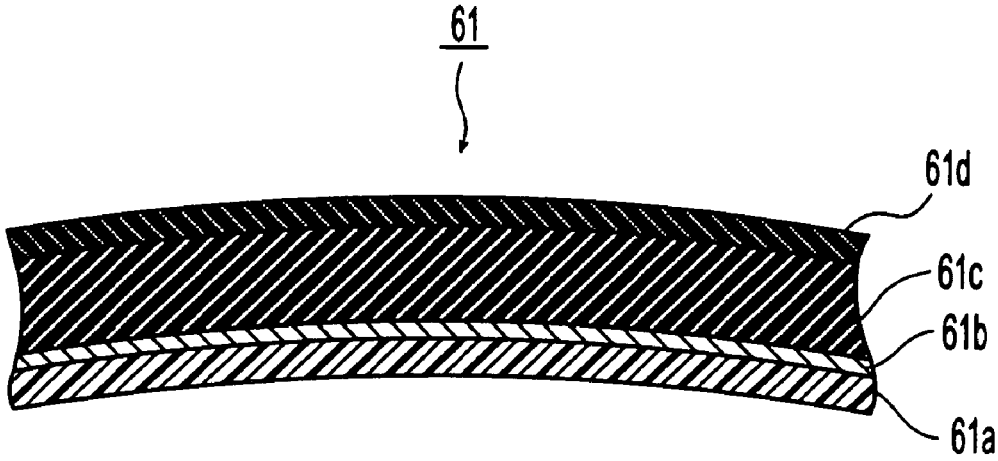
FIGS. 3A and 3B are enlarged cross-sectional views of a fixing belt used in the fixing apparatus.

As shown in FIG. 3A, the fixing belt 61 has a base layer 61*a* of a sheet member having high thermal resistance, a conductive layer 61*b*, an elastic layer 61*c*, and a surface release layer 61*d* as an outer peripheral surface, deposited from its inner peripheral surface side. Further, it may be arranged such that a primer layer or the like for adhesion is provided among these layers.

As the base layer 61*a*, a flexible material having high mechanical strength and thermal resistance such as fluorine resin, polyimide resin, polyamide resin, polyamide imide resin, PEEK resin, PES resin, PPS resin, PFA resin, PTFE resin or FEP resin may be used. The thickness of the base layer 61*a* is 10 to 150 μm or may be 30 to 100 μm. When the thickness is less than 10 μm, the strength as the fixing belt 61 cannot be acquired. When the thickness is greater than 150 μm, the flexibility is lost, and further, the thermal capacity is increased and the temperature-rising time is prolonged. In this exemplary embodiment, a sheet member of polyimide resin having a thickness of 80 μm is employed.

The conductive layer 61*b* is a layer (heat generating layer) where induction heat generation is performed with a magnetic field induced by the electromagnetic induction heating unit 65. As the conductive layer 61*b*, a metal layer of iron, cobalt, nickel, copper, aluminum, chrome or the like having a thickness about 1 to 80 μm is employed. Further, the material and thickness of the conductive layer 61*b* are appropriately selected so as to realize a specific resistance value to acquire sufficient heat generation with an eddy current by the electromagnetic induction. In this exemplary embodiment, a copper layer having a thickness of about 10 μm is employed.

The thickness of the elastic layer 61*c* is 10 to 500 μm or may be 50 to 300 μm. As the material of the elastic layer 61*c*, silicone rubber, fluorine rubber, fluorosilicone rubber or the like having excellent thermal resistance and thermal conductivity is employed. In this exemplary embodiment, silicone rubber having rubber hardness of 15° (JIS-A: JIS-K A type test machine) and thickness of 200 μm is employed.

Upon color image printing, especially printing of photographic image or the like, a solid image is often formed in a large area on the sheet S. Accordingly, when the surface of the fixing belt 61 (surface release layer 61*d*) cannot follow the irregularity of the sheet S or toner image, heating unevenness occurs in the toner image, and glossiness unevenness occurs in a fixed image between an area where a heat transfer amount is large and an area where the heat transfer amount is small. That is, the area where the heat transfer amount is large has high glossiness while the area where the heat transfer amount is small has low glossiness. This phenomenon easily occurs when the thickness of the elastic layer 61*c* is less than 10 μm. Accordingly, the thickness of the elastic layer 61*c* may be set to be equal to or greater than 10 μm, or may be equal to or greater than 50 μm. On the other hand, when the thickness of the elastic layer 61*c* is greater than 500 μm, the thermal resistance of the elastic layer 61*c* is high, and the quick start performance of the fixing apparatus 60 is degraded. Accordingly, the thickness of the elastic layer 61*c* may be set to be equal to or less than 500 μm, or may be equal to or less than 300 μm.

Further, when the rubber hardness of the elastic layer 61*c* is too high, the layer cannot follow the irregularity of the sheet S or toner image and glossiness unevenness easily occurs in a fixed image. Accordingly, the rubber hardness of the elastic layer 61*c* may be set to be equal to or less than 50° (JIS-A: JIS-K A type test machine) or may be equal to or less than 35°.

Further, as a thermal conductivity λ of the elastic layer 61*c*, $\lambda=6\times10^{4}$ to $2\times10^{-3}$ [cal/cm·sec·deg] is appropriate. When the thermal conductivity λ is less than $6\times10^{4}$ [cal/cm·sec·deg], the thermal resistance is high, and the temperature-rising in the surface layer of the fixing belt 61 (surface release layer 61*d*) is slow. On the other hand, when the thermal conductivity λ is greater than $2\times10^{3}$ [cal/cm·sec·deg], the hardness is excessively high or compressed permanent distortion becomes worse. Accordingly, the thermal conductivity λ of the elastic layer 61*c* may be set to $\lambda=6\times10^{-4}$ to $2\times10^{-3}$ [cal/cm·sec·deg], or may be $8\times10^{-4}$ to $1.5\times10^{-3}$ [cal/cm·sec·deg].

Further, as the surface release layer 61*d* becomes into direct contact with the unfixed toner image transferred on the sheet S, it is necessary to use material having excellent release characteristic and excellent thermal resistance. Accordingly, as the material of the surface release layer 61*d*, tetrafluoroethylene perfluoro alkylvinyl ether polymer (PFA), polytetrafluoroethylene (PTFE), fluorine resin, silicone resin, fluorosilicone rubber, fluorine rubber, silicone rubber or the like may be used.

Further, the thickness of the surface release layer 61*d* may be 5 to 50 μm. When the thickness of the surface release layer 61*d* is less than 5 μm, coating unevenness occurs upon film coating and a low release characteristic area is formed, or durability is insufficient. Further, when the thickness of the surface release layer 61*d* is greater than 50 μm, the thermal conductivity is degraded. Especially in the case of the surface release layer 61*d* formed with a resin material, the hardness is too high and the function of the elastic layer 61*c* is degraded. Note that in this exemplary embodiment, PFA having a thickness of 30 μm is employed.

To improve the toner release characteristic in the surface release layer 61*d*, it may be arranged such that an oil coating mechanism to coat the surface release layer 61*d* with oil (lubricant) for prevention of toner offset is provided in contact with the fixing belt 61. Particularly, when toner not containing low softening material is used, the use of the oil coating mechanism is effective.

Figure 3B:
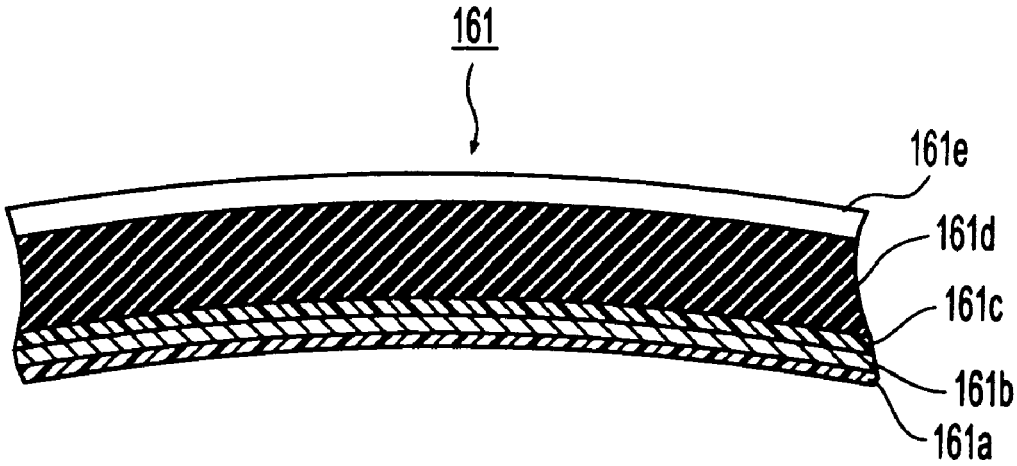

Note that the fixing belt 61 may be replaced with a fixing belt 161 as shown in FIG. 3B. In the fixing belt 161, thermal resistant resin layers 161*a* and 161*c* are separately formed, a conductive layer 161*b* is formed therebetween, and an elastic layer 161*d* and a surface release layer 161*e* are deposited on the surface. In the fixing belt 161, even if the metal layer as the conductive layer 161*b* is thin, degradation due to repetitive reception of bending deformation can be suppressed. Note that the thermal resistant resin layers 161*a* and 161*c* are not limited to thermal resistant resin.

Next, as shown in FIG. 2, the pressure roller 62 has a metal cylindrical member 62*a* as a core, an elastic layer 62*b* of silicone rubber, foamsilicone rubber, fluorine rubber or fluorine resin having thermal resistance formed on the surface of the cylindrical member 62*a*, and an outermost surface release layer 62*c*. The pressure roller 62 is provided in parallel with the rotation axis of the fixing belt 61, and supported with its both ends biased by spring members (not shown) to the fixing belt 61 side. In this exemplary embodiment, the pressure roller 62 is biased to the pressing pad 63 with 294 N (30 kfg) via the fixing belt 61. The pressure roller 62 is driven-rotated in an arrow C direction in accordance with the rotation of the fixing belt 61.

The pressing pad 63 is formed with an elastic material such as silicone rubber or fluorine rubber, thermal-resistant resin or the like such as polyimide resin, polyphenylene sulfide (PPS), polyether sulfone (PES) or liquid crystal polymer (LCP). The pressing pad 63 is provided in a widthwise direction of the fixing belt 61 in an area wider than an area (paper passing area) through which the sheet S is passed, such that the pressure roller 62 is pressed along approximately the entire length of the pressing pad 63.

Further, the pressing pad 63 has a contact surface with respect to the fixing belt 61 as a concave surface along the outer surface shape of the pressure roller 62. In this arrangement, a sufficiently wide nip width can be acquired between the pressing pad and the pressure roller 62 via the fixing belt 61.

Further, to improve slidability between the pressing pad 63 and the fixing belt 61 in a fixing nip part N, a slide sheet 63*a* with excellent slidability and high abrasion resistance, formed with a polyimide film or a fluorine resin-impregnated glass fiber sheet is provided between the pressing pad 63 and the fixing belt 61. Further, the inner peripheral surface of the fixing belt 61 is coated with lubricant. As the lubricant, amino denatured silicone oil, dimethylsilicone oil or the like is used. These materials reduce the friction resistance between the fixing belt 61 and the pressing pad 63, and therefore enable smooth rotation of the fixing belt 61.

The pad support member 64 is a bar-shaped member having an axis line in the widthwise direction of the fixing belt 61. The pressing pad 63 is attached to a portion of the pad support member 64 facing the pressure roller 62, such that the pressing force applied from the pressure roller 62 via the fixing belt 61 to the pressing pad 63 is absorbed by the pad support member 64. For this purpose, the material of the pad support member 64 has rigidity such that the amount of deflection upon reception of the pressing force from the pressure roller 62 is equal to or lower than a predetermined level, or may be equal to or less than 1 mm. Accordingly, considering the necessity of thermal resistance to the influence of magnetic flux by the electromagnetic induction heating unit 65 to be described later, thermal-resistant resin such as glass fiber-containing PPS, phenol, polyimide and liquid crystal polymer, thermal-resistant glass, or metal having a low specific resistance, which is not easily influenced by the induction heating, such as aluminum, is employed. In this exemplary embodiment, the pad support member 64 is formed with an aluminum member having a rectangular cross section with its longer axis in the direction of the pressing force from the pressure roller 62.

Further, in the pad support member 64, a ferrite member 67 of a material with high magnetic inductivity (e.g., ferrite or permalloy) to enhance the heating efficiency by the electromagnetic induction heating unit 65, and a thermistor 70 as an example of an acquisition unit or a temperature sensor to detect the temperature of the fixing belt 61, are fixed in press-contact with the inner peripheral surface of the fixing belt 61 via a spring member 71. In this case, the thermistor 70 is provided in the central portion of the lengthwise direction of the fixing belt 61, and another thermistor (not shown) is provided at one end of the fixing belt 61. Further, the pad support member 64 is provided with a thermo switch (not shown) so as to be in contact with or close to the fixing belt 61. Note that as the temperature detection unit, it may be arranged such that yet another thermistor to detect the temperature of the surface of the pressure roller 62 is provided in place of or in addition to the thermistor 70 to detect the temperature of the fixing belt 61.

Figure 4:
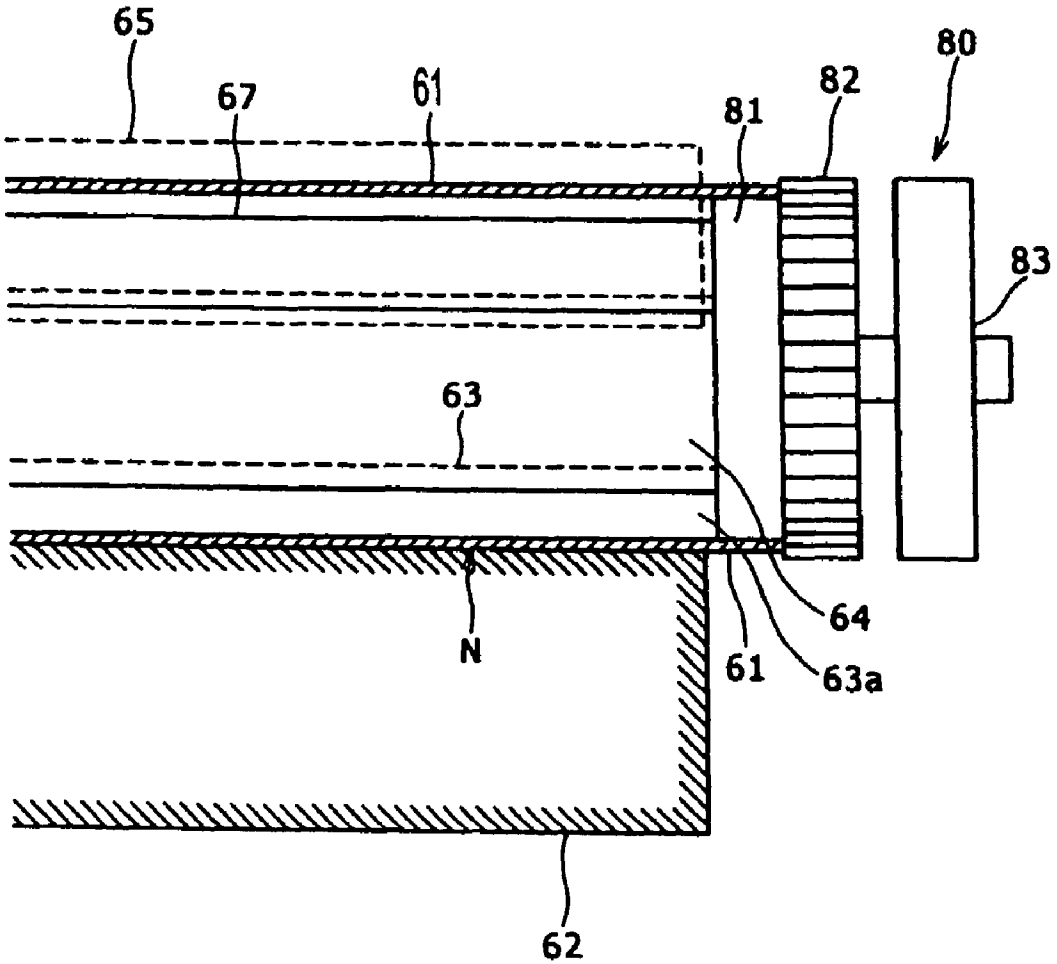
FIG. 4 is an enlarged side view showing the fixing belt supported with a belt running guide.

Further, belt running guides 80 (see FIG. 4) to support the fixing belt 61 and to rotate the fixing belt 61 by the drive motor 68 are provided at both ends of the pad support member 64 in its axial direction. The fixing belt 61, with its inner peripheral surface at the both ends supported with the belt running guides 80, rotates while maintaining a predetermined shape (e.g., approximate circular shape). FIG. 4 is an enlarged side view showing the fixing belt 61 supported with the belt running guide 80. FIG. 4 shows an area around one end of the fixing apparatus 60 viewed from the upstream side in the sheet S conveyance direction.

As shown in FIG. 4, the belt running guide 80 has an end cap 81 inserted in the end of the fixing belt 61 thereby to support the fixing belt 61, a drive gear 82 integrated with the end cap 81, provided in the outside from the end cap 81 in the axial direction of the fixing belt 61, and a rotational shaft 83 integrated with the pad support member 64, to rotatably hold the end cap 81 and the drive gear 82. Note that the drive gear 82 engages with a drive gear (not shown) provided in the drive motor 68.

The fixing belt 61 rotates, while being supported with the end caps 81 integrated with the drive gears 82 in both end inner peripheral surfaces in the widthwise direction of the fixing belt 61. Note that when the pressure roller 62 is in press-contact with the fixing belt 61 by the latch mechanism 69, the pressure roller 62 is driven-rotated in accordance with the rotation of the fixing belt 61. Further, the movement (belt walk) of the fixing belt 61 in its widthwise direction is limited with the drive gears 82, thereby eccentricity of the fixing belt 61 is suppressed.

Next, the electromagnetic induction heating unit 65 will be described. As shown in FIG. 2, the electromagnetic induction heating unit 65 includes a pedestal 65*a* having a curved surface along the outer peripheral surface shape of the fixing belt 61 along the widthwise direction of the fixing belt 61 on the fixing belt 61 side, exciting coils 65*b* supported with the pedestal 65*a*, and an exciting circuit 65*c* as an example of feeding unit to supply high frequency current to the exciting coils 65*b*.

The pedestal 65*a* is formed with an insulating and thermal resistant material such as phenol resin, polyimide resin, polyamide resin, polyamide imide resin or liquid crystal polymer resin. Further, as the exciting coil 65*b*, a Litz wire, including plural copper lines $\phi$0.1 to 0.5 mm in diameter mutually insulated with a thermal-resistant insulating material (e.g., polyimide resin or polyamide imide resin), is coiled plural times (e.g., 11 turns) in closed loop shape such as oval shape, elliptic shape or rectangular shape. The exciting coil 65*b* is bound with adhesive, thereby fixed, with its shape maintained, to the pedestal 65*a*.

Further, the distance between the exciting coil 65*b* and the ferrite member 67, and the conductive layer 61*b* of the fixing belt 61 is within 5 mm, e.g., about 2.5 mm, since these members may be provided as close as possible to each other so as to enhance magnetic flux absorption efficiency.

In the electromagnetic induction heating unit 65, when a high frequency current is supplied from the exciting circuit 65*c* to the exciting coil 65*b*, a magnetic flux repetitively appears and disappears around the exciting coil 65*b*. The frequency of the high frequency current is set to e.g. 10 to 500 kHz. In the present invention, the frequency is set to 20 to 100 kHz. When the magnetic flux from the exciting coil 65*b* passes across the conductive layer 61*b* of the fixing belt 61, a magnetic field to prevent a change of the magnetic field occurs in the conductive layer 61*b* of the fixing belt 61, thereby an eddy current occurs in the conductive layer 61*b*. In the conductive layer 61*b*, Joule heat ($W=I^2R$) in proportional to skin resistance (R) of the conductive layer 61*b* is caused with the eddy current (I), thereby the fixing belt 61 is heated.

Note that at this time, a predetermined temperature of the fixing belt 61 is maintained by controlling the amount of electric power or supply time of high frequency current supplied to the exciting coil 65*b* by the controller 40 (see FIG. 1) of the image forming apparatus based on a measurement value by the thermistor 70.

In the image forming apparatus according to this exemplary embodiment, approximately at the same time of the start of toner image forming operation, electric power is supplied to the drive motor 68 to drive the fixing belt 61 and the electromagnetic induction heating unit 65 in the fixing apparatus 60, and the fixing apparatus 60 is started. Then the fixing belt 61 is rotated. Note that at this time, the pressure roller 62 is away from the fixing belt 61 with the latch mechanism 69. In addition, when the fixing belt 61 passes through a heating area facing the electromagnetic induction heating unit 65, an eddy current is induced to the conductive layer 61*b* of the fixing belt 61, and the fixing belt 61 generates heat. Thereafter, the pressure roller 62 is brought into press-contact with the fixing belt 61 with the latch mechanism 69 at predetermined timing. Then the pressure roller 62 is rotated in accordance with the rotation of the fixing belt 61. Note that the timing of press contact for the pressure roller 62 with respect to the fixing belt 61 will be described later. In a state where the fixing belt 61 has been evenly heated to a predetermined temperature, the sheet S holding an unfixed toner image is fed to the fixing nip part N where the fixing belt 61 and the pressure roller 62 are in press-contact. In the fixing nip part N in the paper passing area, the sheet S and the toner image held on the sheet S are heated and pressed, thereby the toner image is fixed onto the sheet S. Thereafter, the sheet S is separated from the fixing belt 61 by the change of curvature of the fixing belt 61, and conveyed to the discharge paper tray provided at the discharge port of the image forming apparatus. At this time, as an auxiliary unit to completely separate the sheet S from the fixing belt 61, a separation auxiliary member 75 may be provided on the downstream side of the fixing nip part N of the fixing belt 61.

In the fixing apparatus 60 according to this exemplary embodiment, as the fixing belt 61 is evenly heated to the predetermined temperature necessary for fixing a toner image, an excellent toner image where the occurrence of glossiness unevenness, offset or the like is suppressed can be formed. Further, as the fixing belt 61 has an extremely small thermal capacity, the fixing belt 61 can be heated at a high speed. Accordingly, the warm-up time can be extremely short. Further, as the fixing apparatus has an excellent on-demand characteristic, the electric consumption in stand-by time can be greatly reduced.

Further, as a sufficiently wide nip width can be acquired with the pressing pad 63 with respect to the pressure roller 62 via the fixing belt 61, thermal conduction in the fixing nip part. N can be sufficiently performed, and excellent fixing performance can be acquired.

Next, the attachment/separation operation of the pressure roller 62 with respect to the fixing belt 61 will be described in detail.

Figure 5:
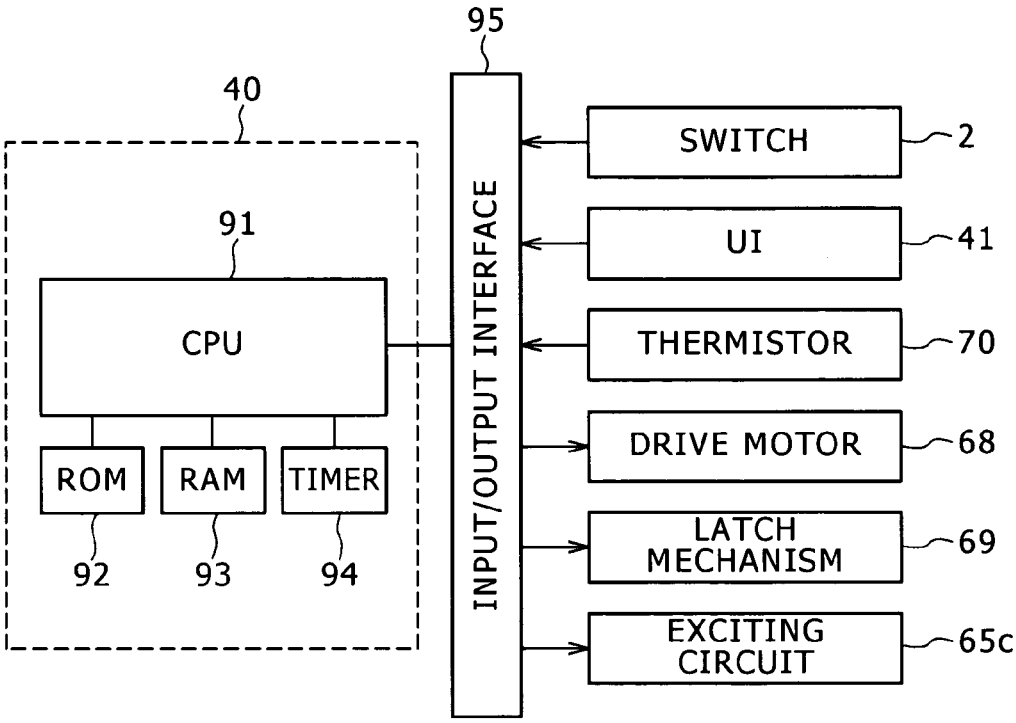
FIG. 5 is a control block diagram of a controller.

FIG. 5 is a control block diagram of the controller 40 in FIG. 1. Note that the controller 40 has a function of controlling the entire image forming apparatus, however, this figure illustrates only blocks related to the operation of the fixing apparatus 60.

A CPU (Central Processing Unit) 91 of the controller 40 performs processing while appropriately performing data transmission/reception with a RAM (Random Access Memory) 93 in accordance with a program stored in a ROM (Read Only Memory) 92. Further, the controller 40 has a timer 94 to perform time measurement. The controller 40 inputs power ON information from a switch 2, operation instruction information at the UI 41 and temperature detection information from the thermistor 70 via an input/output interface 95. On the other hand, the controller 40 outputs control signals to the drive motor 68 to drive the fixing belt 61, the latch mechanism 69 to attach or separate the pressure roller with respect to the fixing belt 61, and the exciting circuit 65*c* to supply electric power to the exciting coil 65*b* so as to heat the fixing belt 61 via the input/output interface 95.

Figure 6:
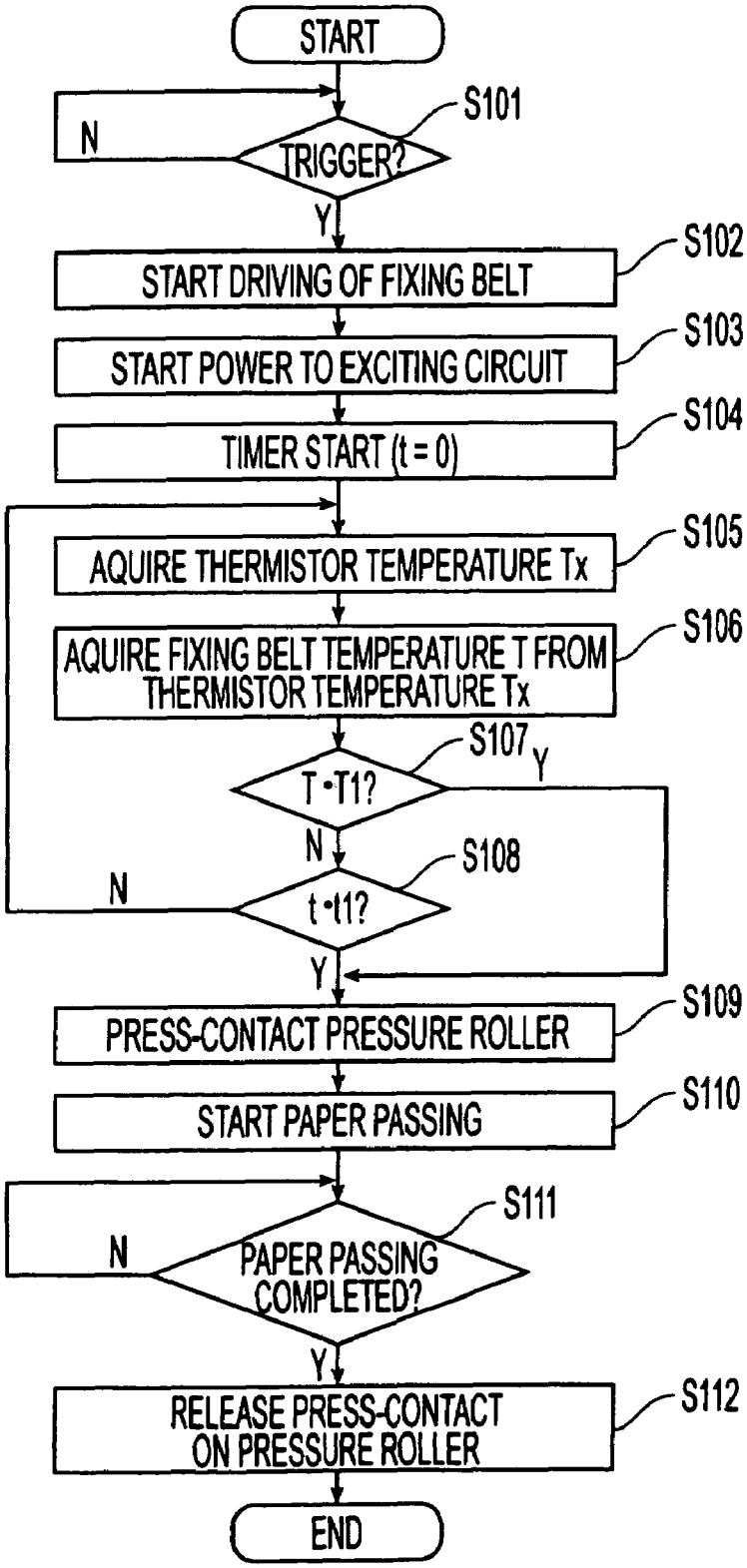
FIG. 6 is a flowchart showing the flow of warm-up processing in the fixing apparatus.

FIG. 6 is a flowchart showing the flow of warm-up processing in the fixing apparatus 60. Note that the following description will be made on the assumption that in the initial stage, the pressure roller 62 is separated from the fixing belt 61 with the latch mechanism 69.

First, the controller 40 determines whether or not preprocessing for image forming operation has been performed in the image forming apparatus, i.e., whether or not a trigger of image forming operation has been detected (step S101). As the trigger, detection of power ON by the user's operation of the switch 2 of the image forming apparatus, the user's opening of a platen cover (not shown) in the image reading apparatus (not shown), detection of placement of an original on an automatic document feeder (not shown) in the image reading apparatus, input of a print signal from the PC (not shown), or the like, is employed.

When it is determined at step S101 that the trigger of image forming operation has been detected, the controller 40 outputs a control signal to the drive motor 68 to start driving of the fixing belt 61 by rotating the drive motor 68 (step S102). Further, the controller 40 outputs a control signal to the exciting circuit 65*c*, to start induction heating of the fixing belt 61 by supplying a high frequency current to the exciting coil 65*b* (see FIG. 2) (step S103). Further, the controller 40 starts time measurement by its internal timer 94 (step S104) at the timing of start (start time t=0) of the supply of the high frequency current to the exciting circuit 65*c*. Note that if it is determined at step S101 that the trigger of image forming operation has not been detected, the process returns to step S101.

Next, the controller 40 acquires a thermistor temperature Tx as a measurement temperature by the thermistor 70 (step S105), then acquires a fixing belt temperature T as the surface temperature of the fixing belt 61 based on the acquired thermistor temperature Tx (step S106). Further, the controller 40 determines whether or not the fixing belt temperature T acquired at step S106 is equal to or higher than a first temperature T1 (step S107). Note that in this exemplary embodiment, the first temperature T1 is a lower limit value of a fixing temperature range appropriate for fixing an unfixed toner image on the sheet S in the fixing apparatus 60. When the controller 40 determines that the fixing belt temperature T is equal to or higher than the first temperature T1, the controller 40 outputs a control signal to the latch mechanism 69 to bring the pressure roller 62 into press-contact with the fixing belt 61 (step S109). On the other hand, when the controller 40 determines at step S107 that the fixing belt temperature T is lower than the first temperature T1, it determines whether or not elapsed time t measured (time elapsed from the start time t=0) by the timer 94 is equal to or longer than first time t1 (step S108). Note that the first time t1 is time in which the temperature of the fixing belt 61 upon normal temperature-rising operation in the fixing apparatus 60 becomes the first temperature T1. When the controller 40 determines that the elapsed time t is equal or longer than the first time t1, the controller 40 outputs a control signal to the latch mechanism 69 to bring the pressure roller 62 into press-contact with the fixing belt 61 (step S109). Note that when the controller 40 determines at step S108 that the elapsed time t is shorter than the first time t 1, the process returns to step S105 to continue processing.

At step S109, the pressure roller 62 is brought into press-contact with the fixing belt 61, then the sheet S holding an unfixed toner image is fed to the fixing nip part N, and paper passing is started (step S10). Then, the toner image is fixed onto the sheet S passing through the fixing nip part N. Thereafter, the controller 40 determines whether or not the last sheet S in the job has passed, i.e., whether or not the paper passing has been completed (step S111). When the paper passing has been completed, i.e., the image forming operation is to be ended, the controller 40 outputs a control signal to the latch mechanism 69 to separate the pressure roller 62 from the fixing belt 61, i.e., release the press-contact state of the pressure roller 62 (step S112), and the series of processings is completed. On the other hand, when the paper passing has not been completed, i.e., the image forming operation is to be continued, the process returns to step S111 to continue the processing.

At the above-described step S106, the fixing belt temperature T is acquired based on the thermistor temperature Tx acquired at step S105. The thermistor 70 is provided in a non-contact state with respect to the fixing belt 61. Further, since the induction heating method is employed in the fixing apparatus 60, when excitation by the exciting coil 65*b* is started upon warm-up operation, the fixing belt 61 having the conductive layer 61*b* is quickly heated. Accordingly, the thermistor temperature Tx measured by the thermistor 70 cannot follow the actual temperature (fixing belt temperature T) of the fixing belt 61 and becomes a lower temperature. In this exemplary embodiment, the thermistor temperature Tx measured by the thermistor 70 upon warm-up operation and the actual fixing belt temperature T at that time are examined beforehand, and the relation between these temperatures is stored as a table in the ROM 92. At step S106, the table stored in the ROM 92 is referred to, and the fixing belt temperature T corresponding to the thermistor temperature Tx acquired at step S105 is acquired.

Next, the warm-up operation or the like in the fixing apparatus 60 will be described in detail with particular examples.

(1) Heating of Fixing Belt 61 from a Room Temperature

Figure 7:
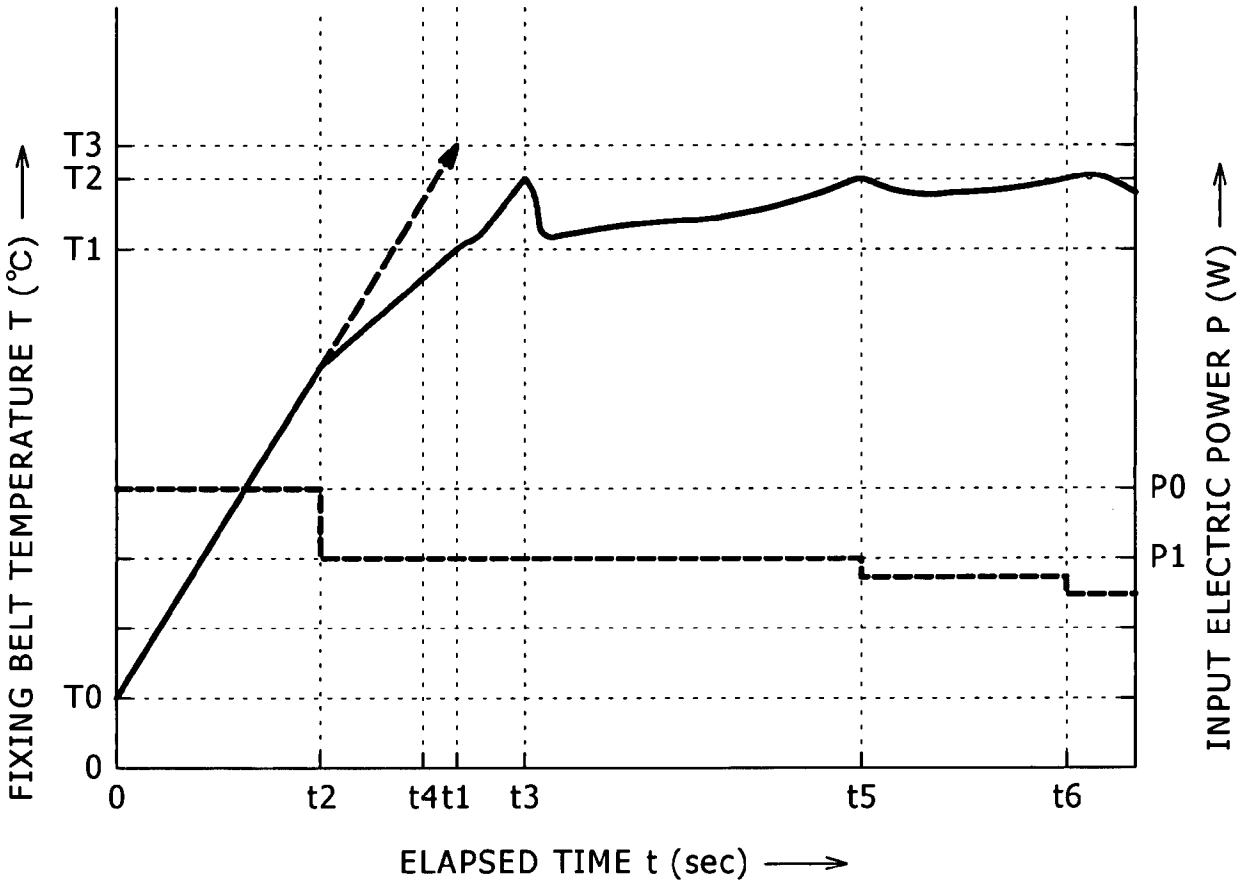
FIG. 7 is a timing chart when the fixing belt is heated from a room temperature.

FIG. 7 shows an example of the warm-up operation and fixing operation in the fixing apparatus 60. In this example, the fixing belt 61 at a room temperature T0 when, e.g., the switch 2 is turned on or when the image forming operation has not been performed for a long time, is heated. Note that in FIG. 7, the horizontal axis indicates the elapsed time t from the heating start time, the left side of the vertical axis indicates the fixing belt temperature T, and the right side of the vertical axis indicates the input electric power P supplied from the exciting circuit 65*c*. Further, in FIG. 7, the solid line indicates the fixing belt temperature T, and the broken line indicates the input electric power P.

When the trigger of image forming operation has been detected (see step S101 in FIG. 6), the rotation of the fixing belt 61 is started as described above, and the supply of electric power from the exciting circuit 65*c* is started (see steps S102 and S103). At this time, as the input electric power P, first electric power P1 as a maximum value of electric power allocated to the fixing apparatus 60 (in this example, corresponding to 100 W) is supplied to the exciting circuit 65*c*, thereby the fixing belt 61 is quickly heated. Note that at this time, electric power supply to the other portions of the image forming apparatus is not sufficient, and most of available electric power (1.5 kVA: AC 100 V×15 A) in the image forming apparatus can be supplied to the fixing apparatus 60 (exciting circuit 65*c*). Further, the time measurement by the timer 94, with the start time as t=0, is started (see step S104).

Next, when a print button or the like has been pressed by the user at time t2, the image forming operation (toner image formation, transfer, paper conveyance and the like) is started. In accordance with the start of the image forming operation, the input electric power P to the exciting circuit 65*c* is reduced to second electric power P2 lower than the first electric power P (in this example, about 750 W to 800 W). The temperature-rising rate of the fixing belt 61 is slightly reduced, however, the fixing belt 61 is further heated. Note that the differential electric power between the first electric power P1 and the second electric power P2 is supplied to other elements including the charger 12 and the laser exposure unit 13. Note that the time t2 is arbitrarily determined by the user but not a fixed value. However, the inventors and the like of the present invention have examined users' apparatus use state and found that the average value of the time t2 is about three seconds.

In this example, the elapsed time t becomes the first time t1 before the fixing belt temperature T acquired based on the thermistor temperature Tx becomes the first temperature T1 (see steps S105 to S108), the pressure roller 62 is brought into press-contact with the fixing belt 61 with the latch mechanism 69 (see step S109), and the pressure roller 62 is driven-rotated in accordance with the rotation of the fixing belt 61. In this arrangement, the heat of the fixing belt 61 is absorbed by the pressure roller 62, and the temperature-rising rate of the fixing belt 61 is rapidly reduced. However, at the first time t1, the fixing belt temperature T has become almost the first temperature (the lower limit value of the fixing temperature range) T1. That is, the fixing apparatus 60 is capable of fixing an unfixed toner image on the sheet S. Note that in this exemplary embodiment, the first time t1 is set to five seconds.

Then, at time t3 at which the sheet S holding the unfixed toner image is sent to the fixing nip part N, the fixing operation is started. The heat of the fixing belt 61 is absorbed by the sheet S, and the fixing belt temperature T is slightly lowered. However, as the input electric power P is still the second electric power P2, the fixing belt temperature T, during the paper passing, gradually rises. Note that at the time t2, the fixing belt temperature T approximately becomes the second temperature T2. The second temperature T2 is a central value in the fixing temperature range appropriate for fixing an unfixed toner image on the sheet S in the fixing apparatus 60. Further, the third temperature T3 is an upper limit value of the fixing temperature range appropriate for fixing an unfixed toner image on the sheet S in the fixing apparatus 60. That is, when the fixing belt temperature T exceeds the third temperature T3, the fixing belt may be damaged due to overheating, or a fault may occur in the fixing apparatus 60. Accordingly, the appropriate fixing temperature range is from the first temperature T1 to the third temperature T3.

Thereafter, power feeding control is performed on the power supply from the exciting circuit 65*c* to the fixing belt 61 such that the fixing belt temperature T is between the first temperature T1 and the third temperature T3, or more particularly, such that the fixing belt temperature T does not exceed the second temperature T2. For example, every time the fixing belt temperature T becomes the second temperature T2 at time t4 or t5, the level of the input electric power P supplied to the exciting circuit 65*c* is gradually reduced. Note that as the fixing belt 61 is heated to a certain degree, the fixing belt temperature T equal to or higher than the first temperature T1 is maintained.

As described above, the time t2 is determined by the user's pressing of the print button or the like, and in the above example, t2=3 sec. holds. However, it is conceivable that the elapsed time becomes the first time t1 without any operation by the user. In such a case, if no measure has been taken, the fixing belt temperature T continuously rises, and as indicated by a broken arrow in FIG. 7, the fixing belt temperature T exceeds the third temperature T3 at the first time t1, that is, exceeds the upper limit value of the fixing temperature range.

In the fixing apparatus 60 according to this exemplary embodiment, when the user's instruction to start the image forming operation has not been issued by second time t6 immediately before the first time t1, feeding to the exciting circuit 65*c* is stopped. At the same time, the pressure roller 62 is brought into press-contact with the fixing belt 61 with the latch mechanism 69. By this arrangement, the troubles caused by overheating of the fixing belt 61 can be avoided. Note that in this example, the second time t6 can be arbitrarily selected from the range of time where the fixing belt temperature T does not exceed the third temperature T3, e.g., about 4.0 to 4.5 seconds.

(2) Heating of Fixing Belt 61 Heated to a Certain Degree

Figure 8:
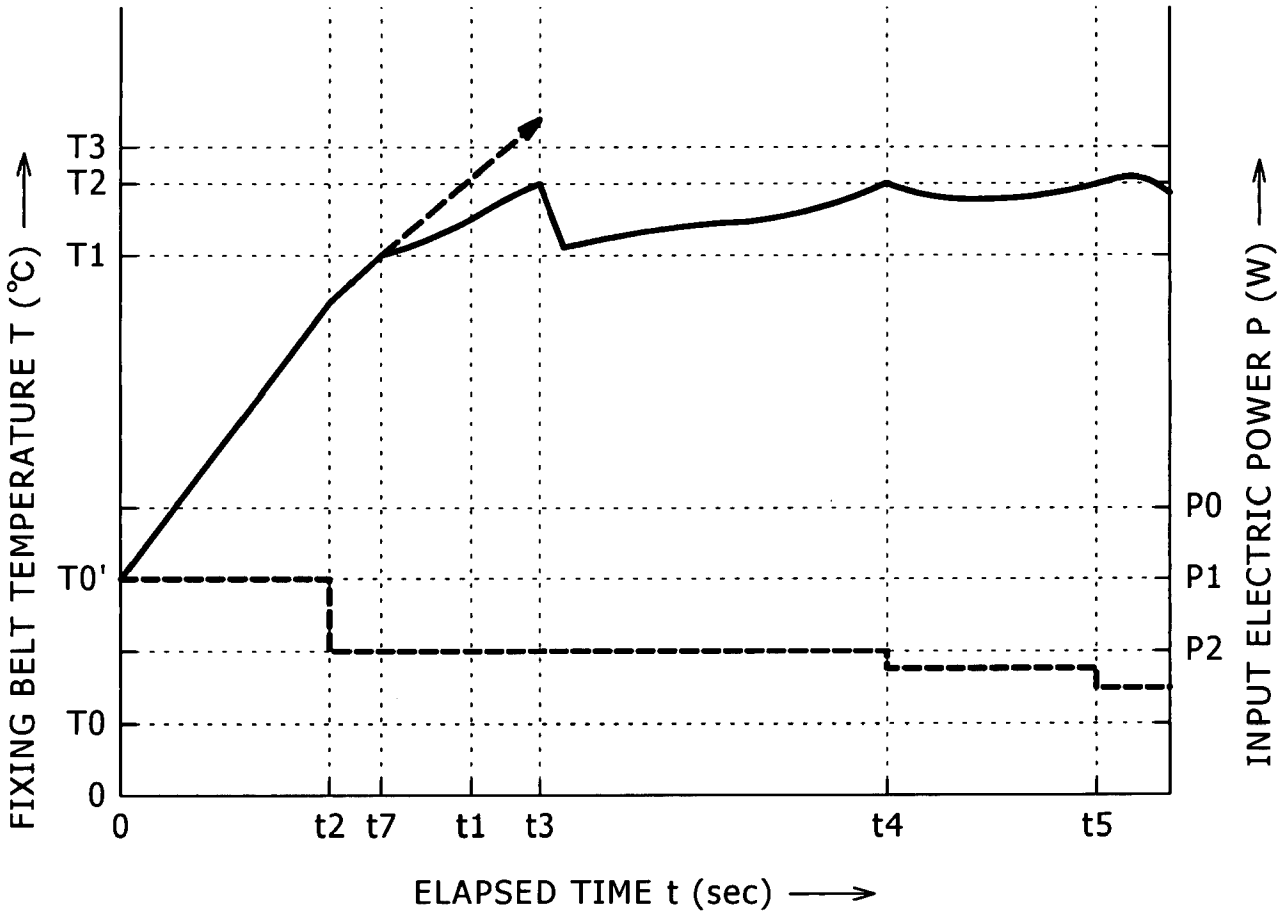
FIG. 8 is a timing chart when the fixing belt heated to a certain degree is heated.

FIG. 8 shows another example of the warm-up operation and the fixing operation in the fixing apparatus 60. In this example, the fixing belt 61, heated to a predetermined temperature T0' (T0'<T1) higher than the room temperature T0, immediately after some job (fixing operation), for example, is heated. Note that the horizontal axis and the vertical axis are the same as those in FIG. 7.

When the trigger of image forming apparatus has been detected (see step S101 in FIG. 6), the rotation of the fixing belt 61 is started as described above, and the electric power supply from the exciting circuit 65*c* is started (see steps S102 and S103). At this time, the second electric power P2, in stead of the first electric power P1 which is the maximum value of electric power allocated to the fixing apparatus 60, is supplied as the input electric power P to the exciting circuit 65*c*. When the fixing belt 61 has been heated to a certain degree, even though the level of the input electric power P is reduced, time required for temperature rising can be short. Further, the time measurement by the timer 94 is started with the starting time as t=0 (see step S104).

Next, when the user presses the print button or the like at the time t2, the image forming operation (toner image formation, transfer, paper conveyance and the like) is started. In accordance with the start of the image forming operation, the input electric power P to the exciting circuit 65*c* is reduced to the third electric power P3 lower than the second electric power P2 (in this example, about 500 W). The temperature-rising rate of the fixing belt 61 is slightly reduced, however, the fixing belt 61 is further heated.

In this example, the fixing belt temperature T acquired based on the thermistor temperature Tx becomes the first temperature T1 before the elapsed time t becomes the first time t1 (see steps S105 to S108), the pressure roller 62 is brought into press-contact with the fixing belt 61 with the latch mechanism 69 (see step S109), and the pressure roller 62 is driven-rotated in accordance with the rotation of the fixing belt 61. Note that time at which the fixing belt temperature T becomes the first temperature T1 is time t7. In this arrangement, the heat of the fixing belt 61 is absorbed by the pressure roller 62, and the temperature-rising rate of the fixing belt 61 is rapidly reduced.

Then, at the time t3 at which the sheet S holding the unfixed toner image is sent to the fixing nip part N, the fixing operation is started. The heat of the fixing belt 61 is absorbed by the sheet S, and the fixing belt temperature T is slightly lowered. However, as the input electric power P is still the third electric power P3, the fixing belt temperature T, during the paper passing, gradually rises. Note that at the time t2, the fixing belt temperature T approximately becomes the second temperature T2.

Thereafter, power feeding control is performed on the power supply from the exciting circuit 65*c* to the fixing belt 61 such that the fixing belt temperature T is between the first temperature T1 and the third temperature T3, or more particularly, such that the fixing belt temperature T does not exceed the second temperature T2. For example, every time the fixing belt temperature T becomes the second temperature T2 at time t4 or t5, the level of the input electric power P supplied to the exciting circuit 65*c* is gradually reduced. Note that as the fixing belt 61 is heated to a certain degree, the fixing belt temperature T equal to or higher than the first temperature T1 is maintained.

If the pressure roller 62 has not been brought into press-contact with the fixing belt 61 by the first time t1, the fixing belt temperature T continuously rises as indicated by the broken arrow in the figure, and at the first time t1, becomes approximately the third fixing temperature T3. In this state, even when the pressure roller 62 is brought into press-contact with the fixing belt 61, it is difficult to suppress the occurrence of overshoot. Accordingly, as in the case of this exemplary embodiment, it is effective to determine the timing of start of press-contact of the pressure roller 62 with respect to the fixing belt 61 at the first time t1 in consideration of the information on the fixing belt temperature T.

Figure 9:
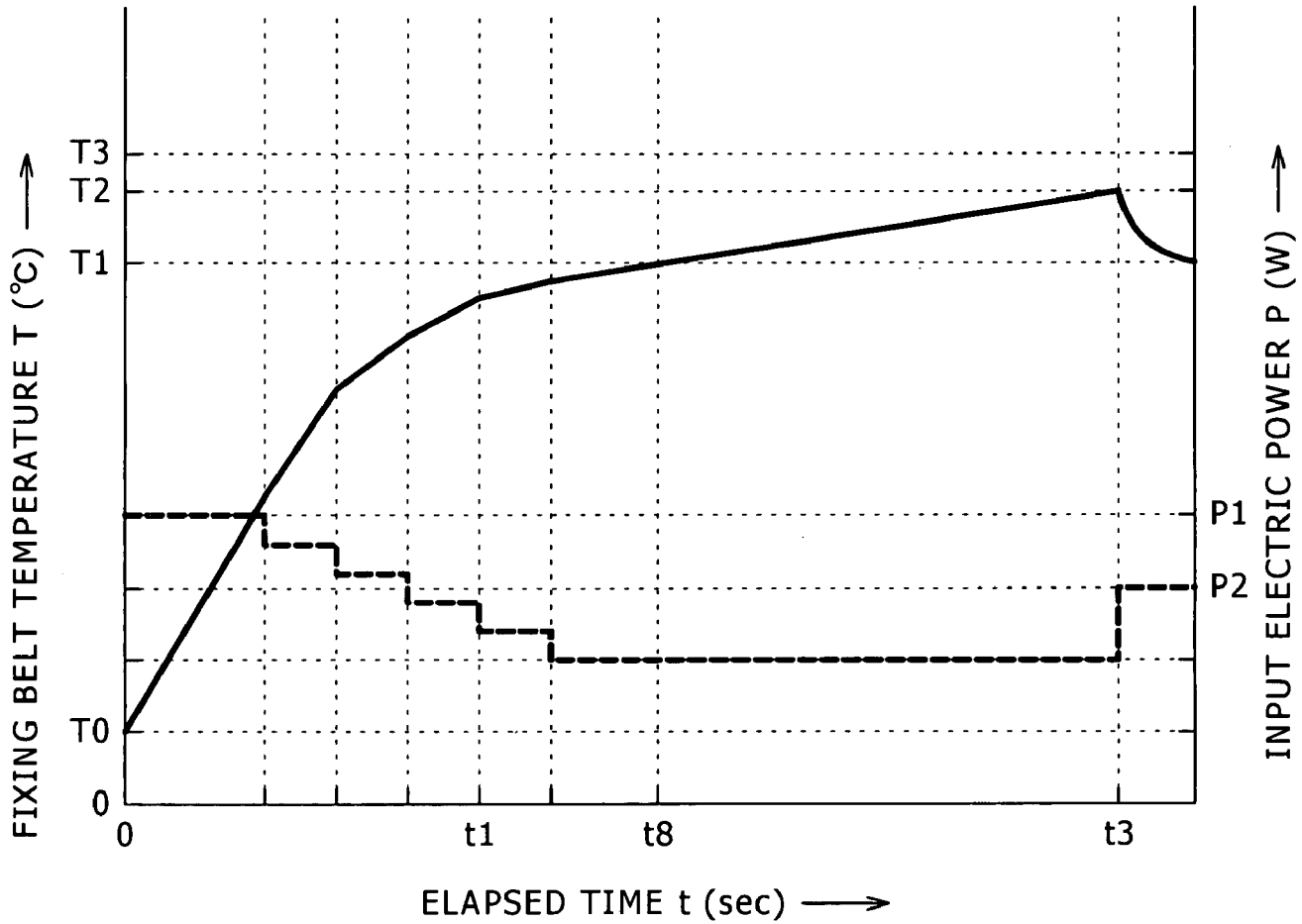
FIG. 9 is a timing chart when an input electric power is gradually reduced during a warm-up operation.

FIG. 9 is a timing chart when an input current P is gradually reduced during the warm-up operation so as to suppress the overshoot of the fixing belt temperature T. In this example, the pressure roller 62 is always in press-contact with the fixing belt 61. Further, the horizontal axis and the vertical axis in FIG. 9 are the same as those described in FIG. 7.

In this example, the input electric power P is gradually reduced from the start time t=0, and in accordance with the reduction, the temperature-rising rate of the fixing belt temperature T is gradually reduced. Then the fixing belt temperature T becomes the first temperature T1 at time t8 far behind the first time t1. Accordingly, the time t3, at which the fixing belt temperature T becomes the second temperature T2 and the paper passing is started, is far behind. Accordingly, it is understood that in this heating method, longer warm-up time is required, and the user's waiting time is prolonged.

As described above, in the fixing apparatus 60 according to this exemplary embodiment, during the warm-up operation, the fixing belt 61 is rotated in a state where the pressure roller 62 is away from the fixing belt 61, and the fixing belt 61 is subjected to the induction-heating. In this arrangement, during the warm-up operation, the heat of the fixing belt 61 is not absorbed by the pressure roller 62 and the temperature of the fixing belt 61 can be quickly increased. That is, the warm-up time in the fixing apparatus 60 can be reduced.

Further, in this exemplary embodiment, when a period, in which the fixing belt 61 is expected to be heated to a predetermined fixing temperature, has been elapsed, or when the temperature measured by the thermistor 70 becomes a temperature corresponding to a predetermined temperature, to which the fixing belt 61 is expected to be heated, the pressure roller 62 is latched onto the fixing belt 61. From another point of view, when temperature of the fixing belt 61 is within the range from the first temperature T1 to the third temperature T3 as an allowable fixing temperature range, the pressure roller 62 is brought into press-contact with the fixing belt 61. In this arrangement, the heat of the fixing belt 61 can be absorbed by the pressure roller 62 before the fixing belt temperature exceeds the upper limit of the fixing temperature range, and the occurrence of overshoot can be suppressed in the fixing apparatus 60 in which temperature-rising is quickly performed.

In this exemplary embodiment, during the warm-up operation, the maximum electric power allocated to the fixing apparatus 60 in the system of the image forming apparatus can be supplied, the warm-up time can be further reduced.

Further, by using the above arrangement, the fixing apparatus 60 can be set to an available state in an extremely short time, and the user's waiting time can be reduced. Further, as it is not necessary to previously warm the fixing belt 61 before the warm-up operation, the stand-by electric power can be reduced.

Accordingly, in the fixing apparatus 60, the occurrence of overshoot can be suppressed, and wasteful electric consumption can be further reduced without the user's convenience.

Note that in this exemplary embodiment, the fixing belt 61 is subjected to the electromagnetic induction heating by using the electromagnetic induction heating unit 65, however, the present invention is not limited to this arrangement. For example, the method used in this exemplary embodiment can be similarly applied to a fixing apparatus where the fixing belt 61 is quickly heated by locally heating the fixing belt 61 with a ceramic heater provided as a heating unit or a supply member inside the fixing belt 61 in a position near the fixing nip part N.

Further, in the exemplary embodiment, the pressure roller 62 is attached/separated to/from the fixing belt 61 by using the latch mechanism 69, however, the present invention is not limited to this arrangement. For example, it may be arranged such that the fixing belt 61 side is latched onto the pressure roller 62. Further, in this exemplary embodiment, the heat of the fixing belt 61 is absorbed by the pressure roller 62 by press-contact with the fixing belt 61, however, the present invention is not limited to this arrangement. For example, it may be arranged such that a press-contact member which can be attached/separated to/from the fixing belt 61 such as a roller is provided in addition to the pressure roller 62, and the press-contact member is brought into press-contact with the fixing belt 61, thereby the heat of the fixing belt 61 is absorbed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing apparatus for fixing an unfixed image on a recording material, comprising:

a heating member, having a conductive layer, that is rotatably provided;

a pressure member that is rotatably provided and that is brought into press-contact with the heating member, thereby forming a fixing nip part to pass the recording material between the pressure member and the heating member;

a heating unit that performs induction heating on the heating member via the conductive layer;

a driving unit that rotates the heating member;

an attachment/separation unit that attaches or separates the heating member to/from the pressure member;

an acquisition unit that acquires information corresponding to a temperature of the heating member; and a controller that drives the heating member by the driving unit and heats the heating member by the heating unit in a state where the heating member and the pressure member are separated by the attachment/separation unit, and that brings the heating member and the pressure member into press-contact by the attachment/separation unit when the information acquired by the acquisition unit satisfies a predetermined condition, wherein the heating member is an endless belt member, the acquisition unit acquires elapsed time from start of heating of the heating member by the heating unit as the information, and the controller brings the heating member and the pressure member into press-contact by the attachment/separation unit when the elapsed time acquired by the acquisition unit is equal to or longer than a predetermined period.

2. The fixing apparatus according to claim 1, wherein the predetermined period is shorter than a period in which the temperature of the heating member heated by the heating unit exceeds an upper limit of a fixing temperature range.

3. A fixing apparatus for fixing an unfixed image on a recording material, comprising:

a heating member, having a conductive layer, that is rotatably provided;

a pressure member that is rotatably provided and that is brought into press-contact with the heating member, thereby forming a fixing nip part to pass the recording material between the pressure member and the heating member;

a heating unit that performs induction heating on the heating member via the conductive layer;

a driving unit that rotates the heating member;

an attachment/separation unit that attaches or separates the heating member to/from the pressure member;

an acquisition unit that acquires information corresponding to a temperature of the heating member; and a controller that drives the heating member by the driving unit and heats the heating member by the heating unit in a state where the heating member and the pressure member are separated by the attachment/separation unit, and that brings the heating member and the pressure member into press-contact by the attachment/separation unit when the information acquired by the acquisition unit satisfies a predetermined condition, wherein the heating member is an endless belt member, the acquisition unit acquires elapsed time from start of heating of the heating member by the heating unit and a temperature acquired by temperature measurement of the heating member as the information, and the controller brings the heating member and the pressure member into press-contact by the attachment/separation unit when at least one of the elapsed time and the temperature acquired by the acquisition unit is equal to or greater than a predetermined value.

4. An image forming apparatus comprising:

a toner image forming unit that forms a toner image;

a transfer unit that transfers the toner image formed by the toner image forming unit onto a recording material;

a fixing unit that fixes the toner image transferred onto the recording material by the transfer unit a timer for time measurement of elapsed time from start of heating of the heating member by the supply member, wherein the fixing unit includes:

a heating member that is rotatably provided and that heats the recording material;

a supply member that supplies heat to the heating member; and a press-contact member that is brought into press-contact with the heating member to absorb the heat from the heating member before a temperature of the heating member heated by the supply member exceeds an upper limit of a predetermined temperature range, and wherein the press-contact member is brought into press-contact with the heating member when the elapsed time measured by the timer is equal to or longer than a predetermined period.

5. The image forming apparatus according to claim 4, wherein the heating member has a conductive layer, and the supply member performs induction heating on the heating member via the conductive layer.

6. A heating method for a fixing apparatus, comprising a rotatable heating member and a pressure member that is brought into press-contact with the heating member, thereby forms a fixing nip part between the pressure member and the heating member, the heating member being heated by electromagnetic induction, the method comprising: rotating the heating member and heating the heating member by electromagnetic induction in a state where the heating member is separated from the pressure member; measuring elapsed time from start of heating and a temperature of the heating member; and bringing the heating member and the pressure member into press-contact when at least one of the measured elapsed time and the temperature is equal to or greater than a predetermined value.

* * * * *